United States Patent [19]

Mannhart et al.

[11] 4,388,826

[45] Jun. 21, 1983

[54] WEAPON SIMULATOR

[75] Inventors: Peter Mannhart, Hochdorf; Bruno Ruppen, Zürich, both of Switzerland

[73] Assignee: Werkzeugmaschinenfabrik Oerlikon-Bührle AG, Zurich, Switzerland

[21] Appl. No.: 304,823

[22] Filed: Sep. 23, 1981

[30] Foreign Application Priority Data

Sep. 26, 1980 [CH] Switzerland ..... 7232/80

[51] Int. Cl.[3] ..... G01N 19/00

[52] U.S. Cl. ..... 73/167

[58] Field of Search ..... 73/167, 432 V

[56] References Cited

U.S. PATENT DOCUMENTS 2,386,376 10/1945 Whitmore .

2,554,714 5/1951 McPherren .

FOREIGN PATENT DOCUMENTS 677176 6/1939 Fed. Rep. of Germany .

1094633 8/1960 Fed. Rep. of Germany .

*Primary Examiner*—S. Clement Swisher

*Attorney, Agent, or Firm*—Werner W. Kleeman

[57] ABSTRACT

A weapon simulator for checking the removal of ammunition from a magazine at the rhythm or cadence with which the firing weapon is fired comprises two cams for feeding the cartridges and mounted upon a shaft driven by a drive motor. The shape of the cams is such that during the removal of the cartridges there occur the same accelerations and decelerations as during the removal of cartridges by means of a firing weapon during series firing.

4 Claims, 2 Drawing Figures

WEAPON SIMULATOR

BACKGROUND OF THE INVENTION

The present invention relates to a new and improved construction of a weapon simulator for testing or checking the removal of ammunition from a magazine at the rhythm or cadence with which the automatic firing weapon is fired.

For triggering series firing at an automatic firing weapon there is required an ammunition magazine provided with a transport or feed device which serves for delivering from the magazine to the automatic firing weapon the ammunition which is needed for the series firing.

For checking the performance or functionality of the transport or feed device and the magazine from which, during series firing, the ammunition is removed by means of the transport or feed device there is required a weapon simulator which replaces the automatic firing weapon.

A firing weapon only can be used for removing ammunition for series firing from a magazine when employing live ammunition, which is immediately fired in the weapon. This is so because without the propellant charge contained in live ammunition no energy is available for operating the firing weapon.

In order to avoid the employment of live ammunition for checking the transport or feed device and the magazine, the automatic firing weapon must be replaced by a weapon simulator. Such weapon simulator must be capable of removing so-called manipulation or handling cartridges from the magazine by means of the transport or feed device at the same rhythm or cadence as a firing weapon.

SUMMARY OF THE INVENTION

Hence, it is a primary object of the present invention to provide a new and improved construction of a weapon simulator of the initially mentioned type which removes the ammunition from an ammunition magazine by means of a transport or feed device essentially in the same manner as a firing weapon.

Another and more specific object of the present invention aims at providing a new and improved construction of weapon simulator, by means of which there are generated, during removal of the ammunition from the magazine, the same accelerations and decelerations of the ammunition as occur during the removal of ammunition from an automatic firing weapon during series firing.

Weapon simulators of this general type are known to the art, but they are only suitable for special weapons and do not implement the aforementioned objects.

The novel weapon simulator according to the present invention is manifested by the features that there are provided:

- two cams for feeding cartridges;
- a shaft upon which there are mounted the cams in spaced relation to one another;
- a drive motor for driving such shaft;
- an infeed channel through which the cartridges are displaced against the cams; and
- a withdrawal channel through which the cartridges are ejected by means of the cams.

BRIEF DESCRIPTION OF THE DRAWINGS

The invention will be better understood and objects other than those set forth above will become apparent when consideration is given to the following detailed description thereof. Such description makes reference to the annexed drawings which depict an exemplary embodiment of a weapon simulator according to the invention and wherein.

DETAILED DESCRIPTION OF THE PREFERRED EMBODIMENTS

Figure 1:
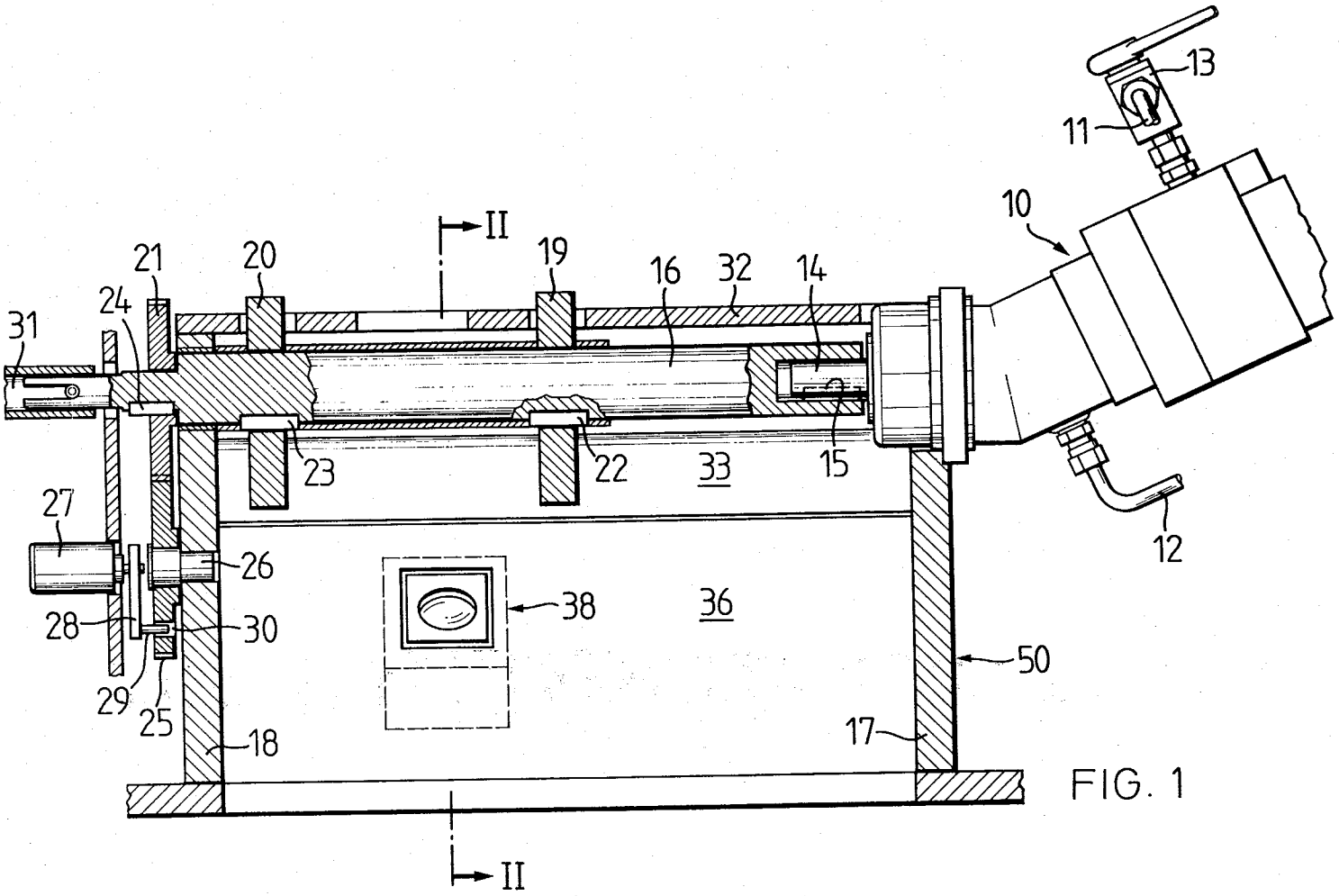
FIG. 1 is a weapon simulator according to the invention shown in longitudinal sectional view, taken substantially along line I—I of FIG. 2.

Describing now the drawings, the exemplary embodiment of weapon simulator according to FIG. 1 will be seen to contain any suitable commercially available hydraulic motor or hydromotor 10. This hydraulic motor or hydromotor 10 is connected to a not here further illustrated but standard pressure medium source by means of an infeed line or conduit 11 and a return flow line or conduit 12. By means of a cock or valve 13 or equivalent structure the infeed line 11 can be blocked, which results in stopping of the hydromotor 10. The hydromotor 10 is provided with a drive pin or journal 14 which drives a shaft 16 with the aid of a key or wedge 15 or the like. Hydromotor 10 is fixed at a wall 17 of a housing, generally indicated by reference character 50, and the shaft 16 is rotatably mounted at a second wall 18 of such housing. By means of keys or wedges 22, 23 and 24 of any other suitable fixation means there are secured to shaft 16 two cam disks or cams 19, 20 and a first gear 21, respectively. The first gear 21 meshes with a second gear 25 which is rotatably mounted at the housing wall 18 by means of a pin or pivot 26. Coaxially arranged with respect to the second gear 25 is a tachometer 27 which is driven by such second gear 25 through a crank arm 28 and a pin or bolt 29. The bolt 29 extends into a bore 30 of the gear 25. At the left end of the shaft 16 there can be attached a crank handle or crank 31, of which only the end thereof has been shown in FIG. 1.

Figure 2:
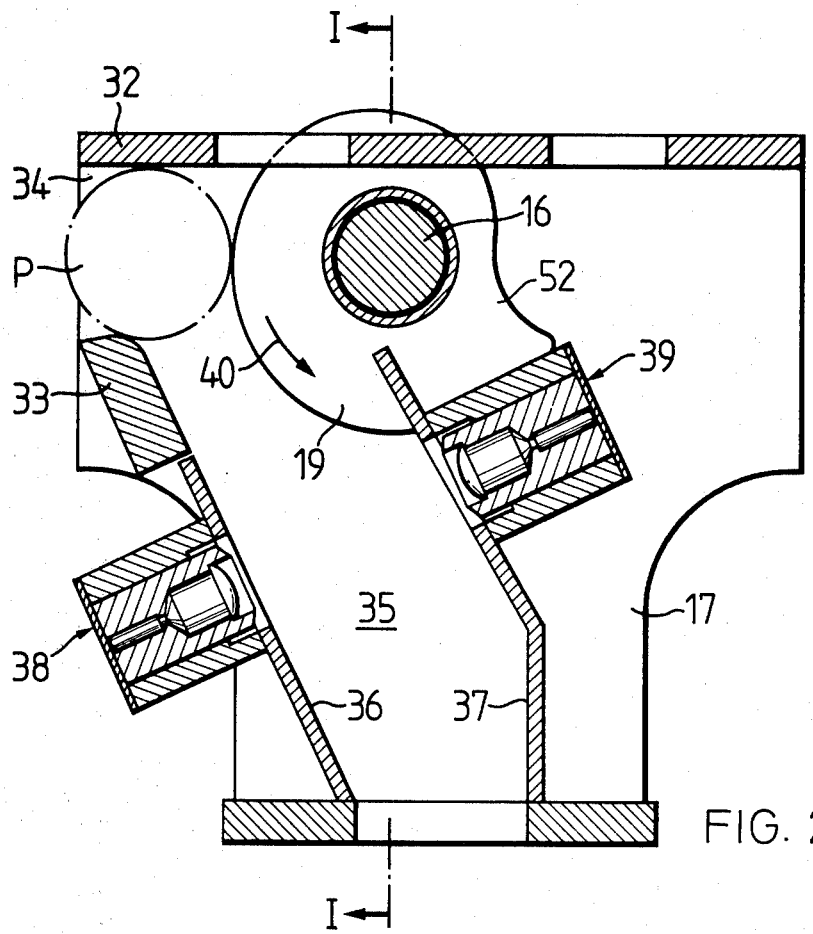
FIG. 2 is the weapon simulator, shown in enlarged cross-sectional view, taken substantially along the line II—II of FIG. 1.

The weapon simulator, as best seen by referring to FIG. 2, will be seen to contain a delivery or infeed channel 34 which serves for receiving the cartridges and is formed, on the one hand, by a cover plate 32 and, on the other hand, by a guide strut 33. Furthermore, there is provided a withdrawal or egress channel 35 which serves for withdrawing the cartridges and is formed by two guide walls 36 and 37. A transmitter 38 is attached to one guide wall 36 and a receiver 39 to the other guide wall 37. By means of the transmitter 38 and the receiver 39, for instance a standard light barrier arrangement, the cartridges can be counted when passing through the withdrawal channel 35. The sense of rotation of the shaft 16 equipped with the cams 19, 20 is indicated by arrow 40 in FIG. 2.

The mode of operation of the weapon simulator described herein is as follows:

The hydromotor 10 is driven at the desired rotational speed which essentially corresponds to the rhythm or cadence with which the firing weapon is fired, i.e. approximately 380 to 700 rounds or shots per minute. Preferably, the rotational speed of the hydromotor 10 is regulated by a conventional regulation or control circuit. In particular, such regulation circuit contains the tachometer 27 illustrated in FIG. 1. Since the shaft 16 equipped with the cams 19 and 20 performs one revolution for feeding one cartridge, the rotational speed of the hydromotor 10 will likewise be in the order of 380 to 700 revolutions per minute.

The shape or configuration of the cams 19 and 20 can be best seen by reverting to FIG. 2. This shape of the cams 19 and 20 can be adapted to the properties of the automatic firing weapon, i.e. the accelerations and decelerations of the cartridges located in the infeed channel 34 should be simulated or reproduced to the extent necessary for checking the ammunition magazine and the transport or feed device. The not particularly illustrated transport or feed device feeds the cartridges from the likewise not particularly illustrated ammunition magazine to the infeed channel 34 and presses the cartridges against the two cam disks or cams 19 and 20.

With every revolution of the shaft 16 the nose 52 of the cams 19, 20 feeds one cartridge from the infeed channel 34 to the withdrawal channel 35.

According to FIG. 2 a cartridge P rests against the cam 19, and specifically, at a location where the curve of the cam 19 has a constant radius. As long as the cartridge rests against this section of the cam disk or cam 19 it will not move. As soon as the radius of the cam disk or cam 19 decreases, the cartridge advances to the right of the showing of FIG. 2.

As soon as the cartridge P is ejected there occurs a rapid displacement of the next following cartridge to the right until it contacts the cam disk or cam 19. Thus, the cartridges are transported at various speeds and undergo accelerations and decelerations which correspond to those occurring in an automatic firing weapon.

Of course, such accelerations and decelerations are also primarily dependent upon the rhythm or cadence of the weapon or, respectively, the rotational speed of the weapon simulator. However, as far as acceleration and deceleration of the cartridge is dependent upon the shape of the cams 19 and 20, such acceleration and deceleration can be controlled by suitably shaping or configuring the cams 19 and 20.

While there are shown and described present preferred embodiments of the invention, it is to be distinctly understood that the invention is not limited thereto but may be embodied and practiced within the scope of the following claims. Accordingly,

What we claim is:

1. A weapon simulator for checking the removal of ammunition from a magazine at a cadence essentially corresponding to that with which an automatic firing weapon is fired, comprising:

a shaft arranged essentially parallel to the lengthwise axis of cartridges which are to be removed;

two cam disks secured in spaced relationship from one another upon said shaft;

said cam disks being structured such that during one revolution of the shaft together with both of the cam disks, said cam disks conjointly cam-out of the magazine a cartridge transversely with respect to its lengthwise axis;

a drive motor for driving said shaft provided with said cam disks;

an infeed channel by means of which the cartridges are infed from the magazine to both of the cam disks; and a withdrawal channel through which the cartridges are ejected by means of both cam disks at the required cadence.

2. The weapon simulator as defined in claim 1, wherein:

the shape of said cam disks essentially corresponds to a cartridge infeed device of a firing weapon; and said shape of said cam disks thus producing essentially the same accelerations and decelerations of the cartridge as a firing weapon.

3. The weapon simulator as defined in claim 1, further including:

means for regulating the rotational speed of said drive motor so as to essentially correspond to the cadence of the firing weapon.

4. The weapon simulator as defined in claim 3, wherein:

said regulating means contains a tachometer.

* * * * *